US009455502B2

(12) United States Patent
Guenter et al.

(10) Patent No.: US 9,455,502 B2
(45) Date of Patent: Sep. 27, 2016

(54) PRESS-IN CONTACT

(71) Applicant: Robert Bosch GmbH, Stuttgart (DE)

(72) Inventors: Friedhelm Guenter, Burgstetten (DE); Sabrina Rathgeber, Gerlingen (DE); Marc Fischer, Reichenbach (DE); Michael Guyenot, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/419,384

(22) PCT Filed: Jul. 24, 2013

(86) PCT No.: PCT/EP2013/065590
§ 371 (c)(1),
(2) Date: Feb. 3, 2015

(87) PCT Pub. No.: WO2014/019906
PCT Pub. Date: Feb. 6, 2014

(65) Prior Publication Data

US 2015/0214636 A1 Jul. 30, 2015

(30) Foreign Application Priority Data

Aug. 3, 2012 (DE) ..... 10 2012 213 812

(51) Int. Cl.

| | |
|---|---|
| ***H01R 13/03*** | (2006.01) |
| ***H01R 4/10*** | (2006.01) |
| ***H01R 12/58*** | (2011.01) |
| ***H01R 43/20*** | (2006.01) |

(52) U.S. Cl.
CPC ..... *H01R 4/10* (2013.01); *H01R 12/585* (2013.01); *H01R 13/03* (2013.01); *H01R 43/20* (2013.01); *Y10T 29/49139* (2015.01)

(58) Field of Classification Search
CPC .... H01R 12/585; H01R 13/03; H01R 43/16; H01R 9/091; H01R 43/205
See application file for complete search history.

(56) References Cited

U.S. PATENT DOCUMENTS

| | | | | |
|---|---|---|---|---|
| 3,732,528 A * | 5/1973 | Vetter | H01R 4/62 174/84 C |
| 4,039,244 A * | 8/1977 | Leachy | H01R 43/16 439/879 |
| 4,442,182 A * | 4/1984 | Chart | H01R 11/26 148/527 |
| 5,230,632 A * | 7/1993 | Baumberger | H01R 12/714 439/591 |

(Continued)

FOREIGN PATENT DOCUMENTS

| | | |
|---|---|---|
| DE | 102006031839 | 1/2008 |
| DE | 102009008118 | 8/2009 |

(Continued)

OTHER PUBLICATIONS

International Search Report for Application No. PCT/EP2013/065590 dated Sep. 30, 2013 (English Translation, 3 pages).

*Primary Examiner* — Gary Paumen
(74) *Attorney, Agent, or Firm* — Michael Best & Friedrich LLP

(57) ABSTRACT

The invention relates to an electrical contact, particularly designed as a press-in pin (16) for a circuit carrier (10). The press-in pin comprises at least one press-in zone (14) at which conductor traces (30) can be contacted. The press-in pin (16) is either made of solid aluminum material (36) or contains at least one aluminum material section (40) or is made of solid aluminum material (36, 46) with a copper jacket coating (48).

11 Claims, 2 Drawing Sheets

(56) References Cited

U.S. PATENT DOCUMENTS

| | | | | |
|---|---|---|---|---|
| 8,771,028 | B2 * | 7/2014 | Tonosaki | H01R 12/585 439/151 |
| 2004/0229077 | A1 | 11/2004 | Mori et al. | |
| 2005/0239345 | A1 | 10/2005 | Furuno et al. | |
| 2009/0064724 | A1 * | 3/2009 | Kim | D06F 37/22 68/23.1 |
| 2012/0117802 | A1 | 5/2012 | Ludwig | |
| 2012/0231677 | A1 | 9/2012 | Kallee | |
| 2015/0194756 | A1 * | 7/2015 | Guenter | H01R 12/585 439/887 |

FOREIGN PATENT DOCUMENTS

| | | |
|---|---|---|
| DE | 102009011934 | 9/2010 |
| DE | 202010013758 | 3/2011 |
| DE | 102011079373 | 1/2013 |
| EP | 1602750 | 12/2005 |
| WO | 2008027167 | 3/2008 |
| WO | 2011125747 | 10/2011 |

* cited by examiner

PRESS-IN CONTACT

BACKGROUND OF THE INVENTION

DE 10 2009 042 385 A1 relates to a plug device for electrically connecting a conductor to a circuit board by plugging the plug device directly into a contact hole in the circuit board into a contact opening in the circuit board. For this purpose, the plug device has a fastening region and a transfer region for transferring a current from the conductor to the circuit board. The transfer region or the entire plug device can be produced from aluminum. Automotive applications are cited as the intended use for the plug device, wherein high mechanical loads are present for example and strong currents are transferred.

DE 10 2005 018 780 A1 discloses a circuit board connector terminal having a stable electric contact with strong retaining force of the terminal. The terminal may be a press-fit terminal or a press-in terminal, which is inserted or clamped in a bus bar for printed circuits or a printed circuit board and is electrically connected to a circuit board. Current is thus transferred from a battery, or electrical signals are transferred without soldering points. The terminal is produced from a conductive material, for example from an aluminum alloy, and is formed by punching and pressing the conductive material. The terminal provides the electrical energy for the bus bar of a circuit in an electric connector box, for example a junction box or a fuse box, and controls electronic elements, such as a fuse or a relay. The bus bar can be provided in an electric connection box which is arranged in a machine room or beneath a vehicle interior.

DE 10 2009 008 118 A1 discloses a method for producing an electric contact on a circuit board, wherein the contact is produced via a force-fit connection between a press-in pin, which has a press-in zone and a contact region, and a metallized circuit board opening. The entire press-in pin or merely the press-in zone can be formed in a manner coated with aluminum.

In the case of control devices currently obtainable on the market for automotive applications, peripheral equipment and circuit carriers is/are often connected by means of press-in or insulation displacement connections, or what is known as cold contacting technology (CCT). Cold contacting technology by means of press-in connections constitutes an inexpensive and robust alternative to soldering technology, for example the THT (through-hole technology) method. With use of press-in connections, a blind joint can also be enabled, for example as is necessary when contacting components located in the cover. Copper and various copper alloys, such as CuNiSi and CuSn6, with a suitable end surface, for example galvanic tin, are currently used within the scope of press-in connections by way of cold contacting technology.

SUMMARY OF THE INVENTION

In accordance with the invention, an electric contact, in particular a press-in pin for a circuit carrier, is proposed. The circuit carrier has at least one press-in zone, at which conductive tracks can be contacted. The press-in pin proposed in accordance with the invention can be manufactured from solid aluminum material, or the press-in pin may alternatively contain aluminum material portions, or may also be formed as a press-in pin manufactured from solid aluminum material which is provided with a coating, in particular a roll-clad copper shell coating. In a preferred variant of the press-in pin proposed in accordance with the invention, which is connected by way of cold contacting technology to the circuit carrier, the solid aluminum material can be covered by a galvanic coating in the first variant of the press-in pin. This galvanic coating may be NiAu or Sn, for example.

In a further variant of the press-in pin proposed in accordance with the invention, said press-in pin is manufactured as a "sandwich" part and for example comprises, sequentially, a resilient region, which is manufactured from copper material and which is pressed in the circuit carrier into the corresponding press-in zone. For example, this first portion of the press-in pin is adjoined by an aluminum portion, within which a deflection zone of the press-in pin is arranged. For example, the term 'deflection zone' means a zone of the press-in pin within which the press-in pin experiences a 90° deflection for example and transitions for example from a vertical profile into a horizontal profile. Instead of the specified 90° deflection, the deflection of the press-in pin may also assume other angular profiles depending on requirements and application.

This Al portion implementing the deflection of the press-in pin can be adjoined in turn by a line portion which is manufactured from Cu or from a Cu alloy. The press-in pin thus constitutes a hybrid component in its second variant.

In a further, third variant of the press-in pin proposed in accordance with the invention, said pin can likewise be manufactured from solid Al material for example, similarly to the first variant. In accordance with the third variant, a Cu shell coating can be applied to the outer surface of this Al material. This Cu shell coating is preferably applied by way of roll cladding. In accordance with the third variant a press-in pin of which the mechanical properties are to be characterized substantially by the Al material is obtained.

The resilient region, that is to say the region of the press-in pin in which said pin is pressed into the circuit carrier, is formed by two side walls which are separated from one another by an opening. Due to the resilience of the side walls, these can be mounted for example by ultrasound assistance in the corresponding press-in zones of the circuit carrier, such that oxides can be better separated from the aluminum material.

The solution proposed in accordance with the invention is characterized in particular in that, due to the use of aluminum instead of copper, or copper alloys, the aluminum material has a lower modulus of elasticity and therefore a lower rigidity than Cu. With identical geometry, improved values in terms of the modulus of elasticity and rigidity compared with copper material are provided. This in turn leads to the fact that thermomechanically induced stresses caused by temperature changes can be better reduced. The press-in pin proposed in accordance with the invention can advantageously still be produced from strip-like material, which accompanies the advantage that tools or proven manufacturing processes do not have to be changed. In order to remove oxides reliably, the press-in pin proposed in accordance with the invention, in its three variants presented above, can be mounted in the corresponding press-in zones of the circuit carrier with ultrasound assistance.

With regard to the producibility of the press-in pin proposed in accordance with the invention, it is emphasized that an electric contact or a plug connection may require a surface that is resistant to fretting corrosion. A surface of this type can be manufactured for example by finishing the complete strips, that is to say the raw material or partly already stamped-out press-in pins, by means of a galvanically applied coating. The galvanic coating may be, for example, NiAu, Sn, NiPdAu or the like.

As a result of the solution proposed in accordance with the invention, the robustness or durability of an electric connection produced by way of cold contacting, this robustness or durability being provided by a plug connection between peripheral equipment, structural component and a circuit carrier, can be considerably improved. As a result of the variants according to the present invention, an existing press-in pin portfolio in electronic control units can be replaced or developed.

The solution proposed in accordance with the invention can be used as media-resistant press-in technology, for example with use in vehicle transmissions, and a cost advantage can be achieved in that the replacement material aluminum can be used instead of copper.

Due to the hybrid form of the press-in pin, an optimal ratio between the mechanically necessary stability on the one hand and the electrical conductivity required in accordance with the specific application can be achieved.

BRIEF DESCRIPTION OF THE DRAWINGS

The invention will be described in greater detail hereinafter with reference to the drawings.

In the drawings.

DETAILED DESCRIPTION

Figure 1:
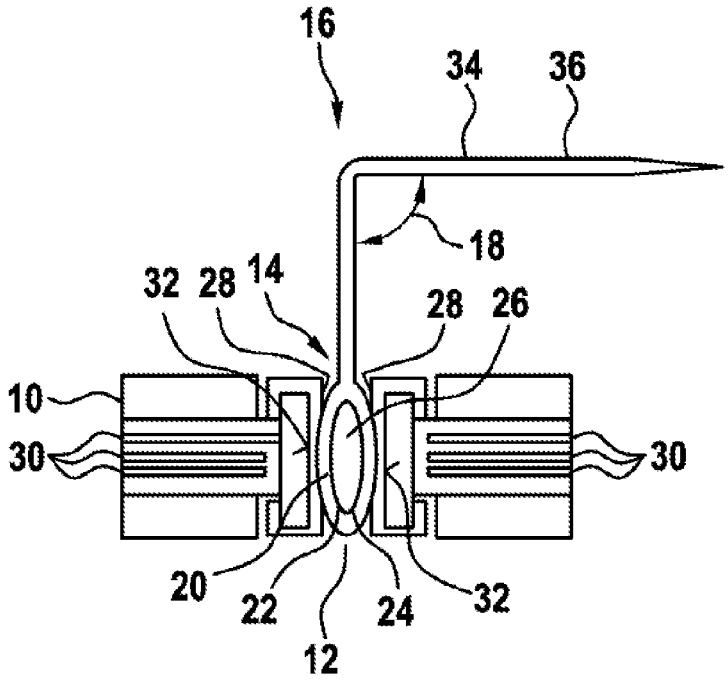
FIG. 1 shows a first variant of a press-in pin proposed in accordance with the invention, produced from solid aluminum material.

A first variant of the press-in pin proposed in accordance with the invention made of solid aluminum material can be inferred from the illustration according to FIG. 1.

FIG. 1 shows a circuit carrier 10, wherein conductive tracks 30 are embedded in the carrier substrate of the circuit carrier 10. The conductive tracks 30 running within the circuit carrier 10 are connected to contact faces 32. The contact faces 32 are in turn surrounded by bearing faces 28, which supplement a press-in opening 12 in the circuit carrier 10. It is clear from the sectional illustration according to FIG. 1 that the press-in opening 12 extends continuously through the circuit carrier 10 from the upper face thereof to the lower face thereof. The press-in opening 12 constitutes a press-in zone 14, into which a press-in pin 16 is pressed. The press-in pin 16 according to the illustration in FIG. 1 is a press-in pin that is manufactured continuously from aluminum material 36. The continuous press-in pin 16 manufactured from solid aluminum material is pressed with ultrasound assistance into the press-in zone 14 of the circuit carrier 10. Oxides can be removed reliably from the aluminum material 36 of the continuous press-in pin 34 due to the ultrasound assistance. In accordance with the first variant of the solution proposed in accordance with the invention, the press-in pin 16 is pressed in by way of cold contacting technology.

It is clear from the illustration according to FIG. 1 that the press-in pin has a 90° deflection 18. This is formed from solid aluminum material 36 of the press-in pin 16, as can be inferred from FIG. 1. At the end of the press-in pin 16 which protrudes into the press-in opening 12 of the press-in zone 14, the press-in pin 16 has a resilient region 20. The resilient region 20 is defined in the aluminum material 36 by a first side wall 22 and a second side wall 24. An opening 26 is present between the side walls 22 and 24. The two side walls 22 and 24 have resilient properties and contact the contact faces 32 once the press-in pin 16 has been mounted in the press-in opening 12. The press-in pin manufactured from solid aluminum material 36 illustrated in FIG. 1 may have a complete or partial galvanic coating. Suitable surfaces are NiAu and Sn, for example.

Figure 2:
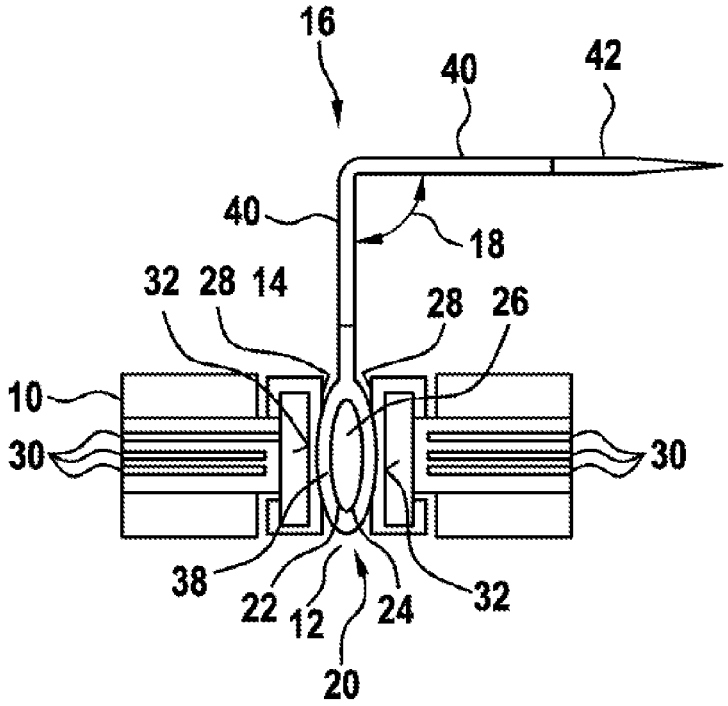
FIG. 2 shows a further, second variant of the press-in pin proposed in accordance with the invention, formed here as a hybrid or sandwich part.

FIG. 2 shows a further, second variant of the press-in pin proposed in accordance with the invention, said pin being formed as a hybrid or sandwich part.

As can be inferred from the illustration according to FIG. 2, this press-in pin 16 is a press-in pin that has a Cu spring region 38, which is adjoined by a deflection region 40 that is manufactured from solid aluminum material and that in turn transitions into a Cu line portion 42. The geometry of the press-in pin in accordance with the illustration in FIG. 2 according to the second variant of the solution proposed in accordance with the invention is identical to the geometry of the press-in pin 16 according to the illustration in FIG. 1, in which the press-in pin is manufactured from solid aluminum material 36.

As shown in FIG. 2, the deflection 18 according to the second variant of the press-in pin 16 is likewise arranged in the portion 40 manufactured from aluminum of the press-in pin 16. The circuit carrier 10 in accordance with the variant according to FIG. 2 is structured similarly to the circuit carrier 10 according to FIG. 1. Conductive tracks 30 run in an embedded manner in the carrier substrate of the circuit carrier 10 and are connected to contact faces 32, which are surrounded by bearing faces 28. The bearing faces 28 ultimately delimit the press-in opening 12, which is arranged within the press-in zone 14 of the circuit carrier 10. Similarly to the illustration according to FIG. 1, the press-in opening 12 extends completely through the circuit carrier 10, that is to say from the upper face thereof to the lower face thereof.

In contrast to the illustration according to FIG. 1, in the case of the press-in pin 16 according to the second variant, which is illustrated in FIG. 2, the Cu spring region 38 is not manufactured from aluminum, but from copper. The aluminum deflection region 40 according to the illustration in FIG. 2 has the advantage that a lower modulus of elasticity and therefore a lower rigidity with identical geometry compared with copper is provided in the region of the deflection 18. Thermomechanically induced stresses caused by temperature changes can also be better reduced with the configuration of the press-in pin 16 in accordance with the second variant according to FIG. 2.

Figure 3:
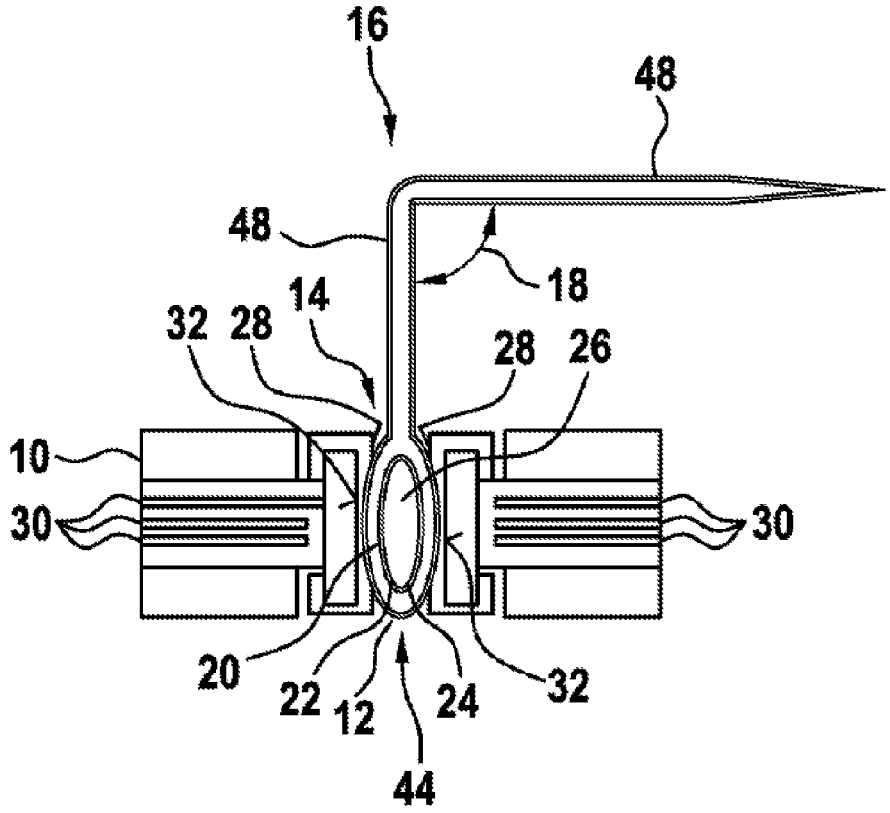
FIG. 3 shows a third variant of the press-in pin proposed in accordance with the invention, in which the solid aluminum material is provided with a galvanic coating.

FIG. 3 shows a further, third variant of the press-in pin proposed in accordance with the invention made of solid aluminum material having a roll-clad coating.

It can be inferred from FIG. 3 that the press-in pin 16 illustrated there is likewise manufactured substantially from Al basic material 36, but is provided over its entire surface with a shell coating 48, which for example can be roll-clad from copper. The mechanical properties of the press-in pin 16 according to the variant reproduced in FIG. 3 are defined substantially by the aluminum material 36, 46. Also in the third variant according to FIG. 3, the geometry of the press-in pins 16 is substantially identical to the geometries of the press-in pin 16 in accordance with the variants described above according to FIGS. 1 and 2.

Similarly, a resilient region 20 of the press-in pin 16 is formed and is provided in the region of the opening 26 on the inner side and on the outer side of the first side wall 22 or the second side wall 24 with a shell coating 48, for example made of copper. The circuit carrier 10 according to FIG. 3 comprises individual conductive tracks 60, which are embedded in the interior of the circuit carrier and are electrically connected to contact faces 32, which are in turn surrounded by bearing faces 28 which delimit the press-in opening 12 of the press-in zone 14 in the circuit carrier 10.

It should also be mentioned in conjunction with the variants of the press-in pin 16 according to FIGS. 2 and 3 that said press-in pin is mounted with ultrasound assistance in the press-in opening 12 of the press-in zone 14. Due to the use of ultrasound with the cold mounting of the press-in pin 16, oxides remaining on the aluminum material can alternatively be removed reliably.

A feature common to all variants of the press-in pins 16 according to FIGS. 1 to 3 is that the press-in pins 16 can be produced, as previously, from strip-like material. This provides the advantage that tools and a proven manufacturing process can remain unchanged. For the case that a plug connection requires a surface that is resistant to fretting corrosion, the above-mentioned strip-like material or already partly stamped-out press-in pins can be finished by means of a galvanically applied coating. Surfaces of this type that are resistant to fretting corrosion include NiAu, Sn and NiPdAu for example, to name a few. As a result of the press-in pins 16 proposed in accordance with the invention according to the described variants, the robustness and therefore the service life of a connection point can be considerably increased. The connection point may be a connection point that constitutes a plug connection between a piece of peripheral equipment and a component on the one hand to the circuit carrier 10 on the other hand. As a result of the solution proposed in accordance with the invention, an existing press-in pin portfolio in electronic control units can be supplemented advantageously. The solution proposed in accordance with the invention can be used in particular within the scope of media-resistant press-in technology, as is necessary for example with use in transmission control units of vehicles. The replacement material aluminum is used instead of the previously used material copper, whereby material costs can be saved in a significant amount since aluminum is a more cost-effective basic material compared with copper. As a result of the solution proposed in accordance with the invention, thermomechanically induced loads can be damped or reduced, and therefore an electric plug connection, which is produced by way of cold contacting technology, is considerably improved in terms of its durability. It would likewise be conceivable to also provide layer sequences, that is to say a layered composite of Cu, Al, Cu and Al. Instead of Cu and Al, other material pairings are also conceivable in the present context for producing hybrid press-in pins, for example Ni, Cu and Au.

What is claimed is:

1. A press-in pin (16) for a circuit carrier (10), having at least one press-in zone (14), at which conductive tracks (30) can be contacted, wherein the press-in pin (16) is at least partially manufactured from solid aluminum material (36, 46), wherein the press-in pin (16) has a deflection (18) in which the press-in pin (16) transitions from a vertical profile into a substantially horizontal profile and which is formed as an aluminum deflection region (40), and wherein the press-in pin (16) comprises, sequentially, a Cu spring region (38), the Al deflection region (40), and a Cu line portion (42).

2. The press-in pin as claimed in claim 1, characterized in that the press-in pin (16) has a resilient region (20), which is formed by a first side wall (22) and a second side wall (24).

3. The press-in pin as claimed in claim 2, characterized in that the solid Al material (36) is provided with a coating made of NiPdAu.

4. A method for producing press-in pins as claimed in claim 1, characterized in that the press-in pins (16) are pressed into the press-in zones in an ultrasound-assisted manner.

5. The method as claimed in claim 4, characterized in that press-in pins (16) are punched out from strip-like material.

6. The method as claimed in claim 5, characterized in that strip-like material or the punched-out press-in pins (16) are coated by a galvanic coating so as to be resistant to fretting corrosion.

7. A press-in pin (16) for a circuit carrier (10), having at least one press-in zone (14), at which conductive tracks (30) can be contacted, wherein the press-in pin (16) is manufactured from solid aluminum material (36, 46) or contains aluminum material portions (40) or is formed from solid aluminum material (36, 46) with a Cu shell coating (48), wherein the press-in pin (16) comprises, sequentially, a Cu spring region (38), an Al deflection region (40), and a Cu line portion (42).

8. The press-in pin as claimed in claim 7, wherein a deflection (18) is arranged in the Al deflection region (40).

9. The press-in pin as claimed in claim 8, characterized in that the press-in pin (16) has a resilient region (20), which is formed by a first side wall (22) and a second side wall (24).

10. The press-in pin as claimed in claim 9, characterized in that the solid Al material (46) is provided with a coating (48) made of NiPdAu.

11. The press-in pin as claimed in claim 9, wherein the solid Al material (46) is provided with a roll-clad Cu shell coating (48).

* * * * *